United States Patent [19]

Harris

[11] 4,079,501

[45] Mar. 21, 1978

[54] METHOD OF PRODUCING A STEEL SLAB FROM AN OPEN-TOP OR HOT-TOP MOLD INGOT

[75] Inventor: James M. Harris, Lutherville, Md.

[73] Assignee: Bethlehem Steel Corporation, Bethlehem, Pa.

[21] Appl. No.: 734,946

[22] Filed: Oct. 22, 1976

[51] Int. Cl.[2] ..... B22D 11/126

[52] U.S. Cl. ..... 527.7; 148/2; 148/128; 164/76; 164/107; 75/43; 29/527.6

[58] Field of Search ..... 29/527.6, 527.7; 148/128, 3, 2; 164/76, 55, 56, 57, 107

[56] References Cited

U.S. PATENT DOCUMENTS

| | | | |
|---|---|---|---|
| 2,218,458 | 10/1940 | Wright | 29/527.7 |
| 3,753,288 | 8/1973 | Orbon, Sr. | 29/527.7 |

*Primary Examiner*—C.W. Lanham
*Assistant Examiner*—V. K. Rising
*Attorney, Agent, or Firm*—Joseph J. O'Keefe; John I. Iverson; Robert M. Jones

[57] ABSTRACT

Maximum yield in the production of a slab from an open-top or hot-top mold ingot is obtained by a method of selecting the ingot mold size and the pour height in the mold.

2 Claims, No Drawings

METHOD OF PRODUCING A STEEL SLAB FROM AN OPEN-TOP OR HOT-TOP MOLD INGOT

BACKGROUND OF THE INVENTION

This invention relates to a method of producing steel slabs. More particularly, it relates to such a method in which the slabs are rolled from an ingot poured in a member of the group of molds consisting of open-top and hot-top molds.

Slabs of steel are ordered on the basis of metallurgical grade, maximum weight, and specified width. According to the metallurgical grade, the steel is poured either into a bottle-cap ingot mold, which is characterized by a fixed volume, or into either an open-top or a hot-top ingot mold, which has a variable volume.

In the past, open-top and hot-top ingots were somewhat arbitrarily assigned a maximum providing yield of 94% and 86%, respectively. This percentage was based upon the maximum yield from the highest yielding ingot size. Thus, to determine the proper size ingot mold and pour height for a particular slab, a data base was first searched to obtain the smallest open-top, or hot-top, depending on the grade ordered, ingot mold in stock that would produce an ingot: (1) having one cross-sectional dimension larger than the sum of said specified width plus the width increment reserved for edge work, and (2) a full mold ingot weight greater than the ordered maximum slab weight.

The ordered maximum slab weight was then divided by the maximum providing yield to obtain the required ingot weight. Ingot weight tables, containing ingot weight versus pour height, were then consulted to obtain the required pour height.

It has been found that the yield from open-top and hot-top ingots varies by as much as 10%, depending upon the ingot size, the pour height, and the slab width. Thus, using the prior art method of determining ingot size and pour height generally resulted in slabs that were lighter than the desired weight.

It is an object of the present invention to provide a method of producing a slab of steel from an open-top or hot-top ingot in which the actual weight of the slab is about equal to the ordered maximum weight of the slab.

SUMMARY OF THE INVENTION

I have discovered that the foregoing object can be obtained by searching a data base, in the same manner as in the prior art, to obtain the smallest open-top or hot-top ingot mold size in stock that will produce an ingot: (1) having one cross-sectional dimension larger than the sum of the desired slab width plus the width increment reserved for edge work, and (2) a full mold ingot weight greater than the maximum slab weight.

Next, an arbitrary pour height, e.g., the lowest height, is selected, and a table is consulted containing data representing the best possible fit of the average yields for various width slabs rolled from ingots of the particular metallurgical grade as a function of pour height in this smallest ingot size. The estimated minimum ingot weight required for the slab is then determined by: (1) determining the maximum providing yield for this pour height and slab width by adding to the average providing yield a number representing the maximum difference between the average providing yield and the maximum providing yield for this smallest mold size, and (2) dividing the maximum slab weight by the maximum providing yield.

A data base containing ingot weight as a function of pour height for this ingot mold size is next consulted to obtain the required pour height for this minimum required ingot weight. The required pour height is then compared with the arbitrarily selected pour height. If these pour heights agree, steel can be poured into this mold to this height. If, however, as is far more likely, these pour heights do not agree, another arbitrary pour height is selected and the above-described steps following such a selection are repeated until there is agreement between the required pour height and the arbitrary pour height.

The selected ingot mold is then filled with molten steel of the ordered metallurgical grade until the agreeing pour height is reached. The steel is allowed to solidify into an ingot, and the ingot is then rolled into a slab of the specified width.

DESCRIPTION OF THE PREFERRED EMBODIMENT

As a specific example of the invention, assume that an order for a semikilled steel is received specifying a maximum slab weight of 25,000 lb (11,340 Kg) and a slab width of 24 in (60.96 cm).

This particular grade of semikilled steel is to be poured in an open-top mold. The ingot must be reduced by a minimum of 4 in (10.16 cm) to provide the slab with the desired edge characteristics. This reduction, referred to in the art as "edge work", must then be added to the specified slab width to obtain the dimension used to determine the minimum ingot mold size.

Reference is here made to Table 1, which is a portion of a data base for determining the initial estimated ingot size for the subject process. As shown, column 1 lists the number of the mold, and column 2 lists the cross-sectional dimensions of the mold. Columns 3 and 4 list the minimum and maximum weights, respectively, of an ingot poured within the permissible height limits for each mold. Columns 5 and 6 list these minimum and maximum pour heights, respectively.

The last column in Table 1 shows the maximum difference between the maximum and average providing yields.

Table 2 lists the coefficients of a paraboloid, representing average providing yield, resulting from a least squares regression analysis of empirical data. This equation is:

$$\text{yield} = A_1 + A_2w + A_3w^2 + A_4h + A_5h^2 + A_6wh$$

where $w$ is width of the slab, $h$ is ingot pour height, and the A's are constants.

TABLE 1

| MOLD NO. | MOLD SIZE | MIN WGT. | MAX WGT. | PR-HGT MN | PR-HGT MX | MAX DIF |
|---|---|---|---|---|---|---|
| 01 | 33 × 40 | 22,090 | 29,320 | 70 | 94 | .040 |
| 02 | 27 × 32 | 13,980 | 16,790 | 65 | 80 | .050 |
| 03 | 23 × 41 | 14,950 | 17,760 | 65 | 78 | .050 |
| 04 | 26 × 42 | 18,000 | 22,000 | 65 | 82 | .075 |
| 05 | 26 × 50 | 20,110 | 25,030 | 65 | 82 | .060 |
| 06 | 31 × 53 | 25,840 | 31,280 | 65 | 82 | .060 |
| 07 | 30 × 59 | 28,650 | 35,160 | 65 | 82 | .050 |
| 08 | 30 × 66 | 31,110 | 39,710 | 65 | 82 | .050 |

TABLE 2

| MOLD NO. | COEFFICIENTS $A_1$ | $A_2$ | $A_3$ | $A_4$ | $A_5$ | $A_6$ |
|---|---|---|---|---|---|---|
| 01 | 00.78367200 | 00.12563400 | −00.00391398 | −00.03002370 | 00.00010241 | 00.00055881 |
| 02 | 01.29413000 | 00.12697000 | −00.00208982 | −00.05649100 | 00.00044248 | −00.00029777 |
| 03 | 00.97316400 | −00.03365590 | −00.00020479 | 00.01083710 | −00.00021531 | 00.00065122 |
| 04 | 01.03843000 | −00.00299370 | 00.00035196 | −00.00361426 | 00.00008664 | −00.00028427 |
| 05 | −00.14691000 | −00.00445747 | 00.00038006 | 00.02904560 | −00.00011250 | −00.00032872 |
| 06 | 02.85047000 | −00.02075170 | 00.00022795 | −00.04420060 | 00.00029397 | 00.00003136 |
| 07 | −01.26458000 | 00.05401430 | −00.00003131 | 00.02003560 | 00.00012867 | −00.00073046 |
| 08 | −00.96540600 | 00.02701780 | −00.00046825 | 00.02679760 | −00.00034407 | 00.00039829 |

As shown in Table 1, ingot mold #5 could qualify as the smallest mold size for the instant order. However, it is clear that the slab yield would have to approach 100% for this mold size to be satisfactory. Therefore, the next larger mold, mold #1, is selected.

Reference is here made to Table 3, which is a data base showing average ingot yields, as a function of both pour height and slab width, for steel of a certain grade poured in mold #1. The first column lists pour height, whereas the remaining columns show average yield as a function of slab width. These yields were calculated from the above equation. The "R-SQUARED" number at the bottom of the table is the Coefficient of Determination. This coefficient is a value that varies from 0 to 1 and is defined as the proportion of the total variance in the dependent variable that is explained by the independent variable. In other words, "R-SQUARED" is the percentage of the data that is explained by the equation.

TABLE 3

Ingot Size = 33 × 40
Minimum Pour Height = 70 Maximum Pour Height = 94
Minimum Width = 18 Maximum Width = 24

| Height \ Width | 18 | 19 | 20 | 21 | 22 | 23 | 24 |
|---|---|---|---|---|---|---|---|
| 94 | .8051 | .8384 | .8639 | .8816 | .8915 | .8935 | .8877 |
| 93 | .8059 | .8387 | .8636 | .8808 | .8901 | .8916 | .8852 |
| 92 | .8069 | .8392 | .8635 | .8801 | .8889 | .8898 | .8829 |
| 91 | .8081 | .8398 | .8637 | .8797 | .8879 | .8882 | .8807 |
| 90 | .8096 | .8407 | .8640 | .8794 | .8870 | .8868 | .8788 |
| 89 | .8112 | .8418 | .8645 | .8794 | .8864 | .8857 | .8771 |
| 88 | .8131 | .8430 | .8652 | .8795 | .8860 | .8847 | .8756 |
| 87 | .8151 | .8445 | .8661 | .8799 | .8859 | .8840 | .8743 |
| 86 | .8173 | .8462 | .8673 | .8805 | .8859 | .8834 | .8732 |
| 85 | .8198 | .8481 | .8686 | .8813 | .8861 | .8831 | .8723 |
| 84 | .8225 | .8502 | .8701 | .8822 | .8865 | .8830 | .8716 |
| 83 | .8253 | .8525 | .8719 | .8834 | .8871 | .8830 | .8711 |
| 82 | .8284 | .8550 | .8738 | .8848 | .8880 | .8833 | .8708 |
| 81 | .8317 | .8577 | .8760 | .8864 | .8890 | .8838 | .8707 |
| 80 | .8351 | .8607 | .8784 | .8882 | .8903 | .8845 | .8708 |
| 79 | .8388 | .8638 | .8809 | .8902 | .8917 | .8853 | .8712 |
| 78 | .8427 | .8671 | .8837 | .8924 | .8934 | .8864 | .8717 |
| 77 | .8468 | .8706 | .8867 | .8948 | .8952 | .8877 | .8724 |
| 76 | .8511 | .8744 | .8898 | .8975 | .8973 | .8892 | .8734 |
| 75 | .8556 | .8783 | .8932 | .9003 | .8995 | .8910 | .8745 |
| 74 | .8603 | .8825 | .8968 | .9033 | .9020 | .8929 | .8759 |
| 73 | .8652 | .8868 | .9006 | .9066 | .9047 | .8950 | .8774 |
| 72 | .8703 | .8914 | .9046 | .9100 | .9076 | .8973 | .8792 |
| 71 | .8757 | .8961 | .9088 | .9136 | 0.9106 | .8998 | .8812 |
| 70 | .8812 | .9011 | .9132 | .9175 | .9139 | .9026 | .8834 |

$A_1$ = .783672E + 00
$A_2$ = .125634E + 00
$A_3$ = −.391398E − 02
$A_4$ = −.300237E − 01
$A_5$ = .102408E − 03
$A_6$ = .558805E − 03
R-SQUARED = .920583

Since both the pour height and the average providing yield are unknown, an arbitrary pour height must be assumed and the process iterated to find the proper pour height and average providing yield. The iteration is begun by estimating the lowest height, viz., 70 in (177.8 cm), for this particular ingot size.

The average providing yield for this pour height and slab width is seen from Table 3 to be 0.8834. However, the maximum allowable ingot weight is obtained by dividing the maximum ordered slab weight by the maximum providing yield. The difference between the average and the maximum providing yields has been determined to be between 2 and 3 standard deviations, or about 4%. Thus, 4% must be added to the average providing yield to obtain the maximum providing yield. In the instant example, the maximum providing yield (MPY) is 0.8834 + 0.04 = 0.9234.

The required ingot weight is obtained by dividing the maximum ordered slab weight by the MPY.

25,000 lb (11,340 Kg)/0.9234 = 27,074 lb (12,280 Kg).

Table 4 shows ingot weight as a function of pour height for an ingot poured in Mold #1. The first column lists pour heights. Columns 2, 3 and 4 list weights for a particular grade of rimmed steel, a chemically capped steel, and a semikilled steel, respectively.

TABLE 4

| Pour Height (in) | 33 × 40 INGOT WEIGHTS (lb) Rim | Chem. Cap | Semi Killed |
|---|---|---|---|
| 70 | | | 22,090 |
| 71 | | | 22,390 |
| 72 | 22,160 | 22,600 | 22,690 |
| 73 | 22,460 | 22,910 | 23,000 |
| 74 | 22,750 | 23,210 | 23,300 |
| 75 | 23,050 | 23,510 | 23,600 |
| 76 | 23,340 | 23,810 | 23,910 |
| 77 | 23,640 | 24,110 | 24,210 |
| 78 | 23,930 | 24,410 | 24,510 |
| 79 | 24,230 | 24,700 | 24,810 |
| 80 | 24,520 | 25,010 | 25,120 |
| 81 | 24,820 | 25,320 | 25,420 |
| 82 | 25,110 | 25,610 | 25,720 |
| 83 | 25,410 | 25,920 | 26,020 |
| 84 | 25,700 | 26,210 | 25,320 |
| 85 | 26,000 | 26,520 | 26,630 |
| 86 | 26,290 | 26,820 | 26,930 |
| 87 | 26,580 | 27,110 | 27,230 |
| 88 | 26,880 | 27,420 | 27,530 |
| 89 | 27,170 | 27,710 | 27,830 |
| 90 | 27,470 | 28,020 | 28,130 |
| 91 | 27,760 | 28,320 | 28,430 |
| 92 | 28,060 | 28,620 | 28,730 |
| 93 | | 28,920 | 29,030 |
| 94 | | 29,220 | 29,320 |

Reference to Table 4 shows that the required pour height for this ingot weight is 87 in (221 cm). Since this height does not agree with the height arbitrarily selected to obtain this weight, a new arbitrary height must be selected and the subsequent steps repeated. Generally, the pour height just read from Table 4 should be used as the new arbitrary height.

From Table 3 the average yield for a pour height of 87 in (221 cm) is seen to be 0.8743. The MPY would then be 0.8743 + 0.04 = 0.9143. The required ingot weight is then:

25,000 lb (11,340 Kg)/0.9143 = 27,343 lb (12,403 Kg).

Reference to Table 4 shows that the required pour height for this ingot weight is 88 in (224 cm). Since this height does not agree with the second arbitrarily selected height, a new height must be selected and the subsequent steps repeated again.

The pour height just read from Table 4 is used as a third arbitrary pour height of 88 in (224 cm). From Table 3 the average yield for this pour height is 0.8756. The MPY is thus 0.8756 + 0.04 = 0.9156. The required ingot weight is then:

25,000 lb (11,340 Kg)/0.9156 = 27,304 lb (12,385 Kg)

Reference to Table 4 shows that the required pour height for this ingot weight is 88 in (224 cm). Therefore, this pour height is correct, and the iteration is complete.

After this ingot mold size and pour height have been selected, molten steel of the ordered semikilled grade is poured into the ingot mold until the agreeing pour height is reached. However, if the steelmaking facilities are provided with sensitive scales, a corresponding ingot weight may be used as the criterion for stopping the pour rather than ingot pour height.

This steel is allowed to solidify in the mold and is then rolled into a slab of the specified width.

I claim:

1. A method of producing, from an ingot made in a member of the group of molds consisting of open-top and hot-top molds, a slab of steel of a certain metallurgical grade, a maximum weight, and a specified width, comprising:

(a) searching a data base to obtain the smallest ingot mold size in stock, for the member mold, that will produce an ingot:

(1) having one cross-sectional dimension larger than the sum of said certain width plus the width increment reserved for edge work, and

(2) a full mold ingot weight greater than said maximum weight, (b) obtaining from data, representing the best possible fit of the average yields for various width slabs rolled from ingots of said metallurgical grade made to various heights in said smallest mold size, the average providing yield for the combination of said specified width and one of the pour heights in said data, (c) determining the estimated minimum required ingot weight for said slab by:

(1) determining the maximum providing yield for said combination by adding to said average yield a number representing the maximum difference between the average providing yield and the maximum providing yield for said smallest mold size of said member of said group of ingots, and

(2) dividing said maximum slab weight by said maximum providing yield, (d) obtaining from a data base the required pour height for said ingot mold size to obtain said minimum required ingot weight, (e) comparing said required pour height with said one of the pour heights in said last-named data base, and

(1) if said required pour height agrees with said one of the pour heights in said data base, progressing to the next step in the process,

(2) if said required pour height does not agree with said one of the pour heights in said data base, repeating steps (b), (c), (d), and (e), for the pour height obtained during the next preceding step (d), until the pour height selected in step (b) agrees with the required pour height obtained in step (d), (f) pouring molten steel of said certain metallurgical grade into said smallest member ingot mold until the agreeing pour height is reached, (g) allowing the steel in said mold to solidify into an ingot, and (h) rolling said ingot into a slab of said specified width.

2. A method as recited in claim 1, in which the average providing yields in step (b) are represented by an equation obtained by a paraboloid least squares regression analysis.

* * * * *